US005405728A

United States Patent [19]

Hopper et al.

[11] Patent Number: 5,405,728

[45] Date of Patent: Apr. 11, 1995

[54] TONER AGGREGATION PROCESSES

[75] Inventors: Michael A. Hopper, Toronto; Raj D. Patel, Oakville; Grazyna E. Kmiecik-Lawrynowicz, Burlington, all of Canada

[73] Assignee: Xerox Corporation, Stamford, Conn.

[21] Appl. No.: 83,116

[22] Filed: Jun. 25, 1993

[51] Int. Cl.[6] ..... G03G 9/097
[52] U.S. Cl. ..... 430/137; 430/104
[58] Field of Search ..... 430/137, 109

[56] References Cited

U.S. PATENT DOCUMENTS

| | | | |
|---|---|---|---|
| 4,137,188 | 1/1979 | Uetake et al. | 252/62.1 P |
| 4,558,108 | 12/1985 | Alexandru et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,133,992 | 7/1992 | Nair et al. | 430/109 |
| 5,215,854 | 6/1993 | Yamazaki et al. | 430/137 |

*Primary Examiner*—John Goodrow
*Attorney, Agent, or Firm*—E. O. Palazzo

[57] ABSTRACT

A process for the preparation of toner compositions comprising (i) preparing a pigment dispersion in water, which dispersion is comprised of a pigment, an ionic surfactant and optionally a charge control agent;

(ii) shearing the pigment dispersion with a latex containing a controlled solid contents of from about 50 weight percent to about 20 percent of polymer or resin, counterionic surfactant and nonionic surfactant in water, counterionic surfactant with a charge polarity of opposite sign to that of said ionic surfactant thereby causing a flocculation or heterocoagulation of the formed particles of pigment, resin and charge control agent to form a dispersion of solids of from about 30 weight percent to 2 percent comprised of resin, pigment and optionally charge control agent in the mixture of nonionic, anionic and cationic surfactants;

(iii) heating the above sheared blend at a temperature of from about 5° to about 25° C. about below the glass transition temperature (Tg) of the resin while continuously stirring to form toner sized aggregates with a narrow size dispersity; and (iv) heating the electrostatically bound aggregated particles at a temperature of from about 5° to about 50° C. about above the (Tg) of the resin to provide a toner composition comprised of resin, pigment and optionally a charge control agent.

30 Claims, 1 Drawing Sheet

TONER AGGREGATION PROCESSES

BACKGROUND OF THE INVENTION

The present invention is generally directed to toner processes, and more specifically to aggregation and coalescence processes for the preparation of toner compositions comprised, for example, of toner resins, or polymers, pigment, and toner additives, such as charge control agents. In embodiments, the present invention is directed to the economical preparation of toners without the utilization of the known pulverization and/or classification methods, and wherein toners with an average volume diameter of from about 0.5 to about 25, and preferably from 1 to about 10 microns and narrow GSD can be obtained. The resulting toners can be selected for known electrophotographic imaging and printing processes, including color processes, and lithography. In embodiments, the present invention is directed to a process comprised of dispersing a pigment and optionally a charge control agent or additive in water containing an ionic surfactant, and shearing this mixture with a latex mixture, comprised of suspended resin particles of from about 0.05 micron to about 1 microns in volume diameter, in water containing a counterionic surfactant in amounts of from about 0.5 to 5 percent (weight percent) of the mass of the latex with opposite charge to the ionic surfactant of the pigment dispersion, and nonionic surfactant, thereby causing flocculation of the resin particles, pigment particles and optional charge control particles, followed by heating, below, for example from about 5° to about 20° C., the Tg of the resin, and stirring of the flocculent mixture which is believed to form statically bound aggregates of from about 0.5 micron to about 5 microns, comprised of resin, pigment and optionally charge control and thereafter heating at, for example, from about 10° to about 50° C., above the Tg of the latex resin to generate toners ,with an average particle volume diameter of from about 1 to about 25 microns and wherein the concentration of the latex is decreased from 40 percent to 1 percent by weight of the total suspension of latex, pigment, surfactant in water and preferably from 30 percent to 5 percent by weight in the aggregating suspension while maintaining the same or similar coagulant surfactant-/latex surfactant ratio of from about 0.5:1.0 to 4:1 thereby enabling the formation of toner aggregates the size of which depend primarily inversely on the latex particle concentration in the blend. Specifically for example, the size of the aggregate produced when a particular latex is aggregated in this manner, under conditions where the ratio of counterionic surfactant coagulant to latex ionic surfactant is fixed, is small, for example 2 microns in volume average diameter at high latex loadings (30 percent solids) and larger, for example 8 microns in volume average diameter at low loadings (5 percent solids). The process of aggregating identical lattices at differing solids loadings of the latex in the dispersion while maintaining a constant ratio of counterionic surfactant coagulant to latex ionic surfactant ensures aggregates of a uniform chemical composition and allows for the formation of a wide variety of toner particles of preselected sizes, each with a narrow size distribution (GSD) of, for example, from about 1.16 to about 1.26 as measured on the Coulter Counter. It is believed that during the higher temperature heating stage, the aggregate particles fuse together to form toners. In another embodiment thereof, the present invention is directed to an in situ process comprised of first dispersing a pigment, such as HELIOGEN BLUE TM or HOSTAPERM PINK TM, in water containing a cationic surfactant such as benzalkonium bromide (SANIZOL B-50 TM), utilizing a high shearing device such as a Brinkmann Polytron, microfluidizer or sonicator, thereafter shearing this mixture with a latex of suspended resin particles such as PLIOTONE TM, comprised of poly(styrenebutadiene) and of particle size ranging from 0.01 to about 0.5 micron in average volume diameter as measured by the Brookhaven nanosizer, in an aqueous surfactant mixture containing an anionic surfactant such as sodium dodecylbenzene sulfonate (for example NEOGEN R TM or NEOGEN SC TM) and nonionic surfactant such as alkyl phenoxy poly(ethylenoxy)ethanol (for example IGEPAL 897 TM or ANTAROX 897 TM), thereby resulting in a flocculation, or heterocoagulation of the resin particles with the pigment particles; and which on further, from for example about 1 to about 3 hours, stirring while heating below the Tg of the latex resin results in formation of statically bound aggregates ranging in size of from about 0.5 microns to about 10 microns in average diameter size as measured by the Coulter Counter (Microsizer II); and thereafter heating to, for example, from about 5° to about 50° C. above the Tg of the latex resin, of, for example, from about 60° to about 95° C., to provide for particle fusion or coalescence of the polymer and pigment particles; followed by washing with, for example, hot water to remove surfactant, and drying whereby toner particles comprised of resin and pigment with various particle size diameters can be obtained, such as from 1 to 12 microns in average volume particle diameter and wherein the solids loading of the latex in the dispersion is decreased by diluting with water from the range of about 40 percent to 2 percent with a preferred range of decrease being from about 30 percent to 5 percent. The aforementioned toners are especially useful for the development of colored images with excellent line and solid resolution, and wherein substantially no background deposits are present.

While not being desired to be limited by theory it is believed that the flocculation or heterocoagulation is formed by the neutralization of the pigment mixture containing the pigment and cationic surfactant absorbed on the pigment surface, with the resin mixture containing the resin particles and anionic surfactant absorbed on the resin particle. The high shearing stage ensures the formation of a uniform homogeneous flocculated system, or gel, from the initial inhomogeneous dispersion which results from the flocculation action, and allows the formation of stabilized aggregates that are negatively charged and comprised of the resin and pigment particles of about 0.5 to about 5 microns in volume diameter. Thereafter, heating is applied to fuse the aggregated particles or coalesce the particles to toner comprised of polymer and pigment, and optionally charge control agent. Furthermore, in other embodiments the ionic surfactants can be exchanged, such that the pigment mixture contains the pigment particle and anionic surfactant, and the suspended resin particle mixture contains the resin particles and cationic surfactant; followed by the ensuing steps as illustrated herein to enable flocculation by homogenization, to form statically bounded aggregate particles by stirring of the homogeneous mixture, and toner formation after heating. The latex resin particles for the aggregation is selected for its functional performance in the xerographic process, especially the process involved with fixing the image to the final receptor medium, usually paper. The utilization of a constant counterionic pigment dispersion surfactant to latex surfactant ratio when aggregating the latex under differing solid loadings ensures a consistent toner chemical composition while also providing a means to obtain narrow size toner distributions. The solids content decrease by diluting with water enables, for example, toner particle size control.

In reprographic technologies, such as xerographic and ionographic devices, toners with average volume diameter particle sizes of from about 9 microns to about 20 microns have been effectively utilized. Moreover, in some xerographic systems, such as the high volume Xerox Corporation 5090 copier-duplicator, high resolution characteristics and low image noise are highly desired, and can be attained utilizing the small sized toners of the present invention with an average volume particle of less than 11 microns, preferably less than about 7 microns and more preferably from 1 to about 7 microns, and with narrow geometric size distribution (GSD) of from about 1.2 to about 1.3. Additionally, in some xerographic systems wherein process color is utilized such as pictorial color applications, small particle size colored toners of from about 3 to about 9 microns are desired to avoid paper curling. Paper curling is especially observed in pictorial or process color applications wherein three to four layers of toners are transferred and fused onto paper. During the fusing step, moisture is driven off from the paper due to the high fusing temperatures of from about 130° to 160° C. applied to the paper from the fuser. Where only one layer of toner is present such as in black or in highlight xerographic applications, the amount of moisture driven off during fusing is reabsorbed proportionally by paper and the resulting print remains relatively flat with minimal curl. In pictorial color process applications wherein three to four colored toner layers are present, a thicker toner plastic level present after the fusing step inhibits the paper from sufficiently absorbing the moisture lost during the fusing step, and image paper curling results. These and other disadvantages and problems are avoided or minimized with the toners and processes of the present invention. It is preferable to use small toner particle sizes such as from about 1 to 7 microns and with higher pigment loading such as from about 5 to about 12 percent by weight of toner, such that the mass of toner layers deposited onto paper is reduced to obtain the same quality of image and resulting in a thinner plastic toner layer onto paper after fusing, thereby minimizing or avoiding paper curling. Toners prepared in accordance with the present invention enable the use of lower fusing temperatures such as from about 120° to about 150° C. thereby avoiding or minimizing paper curl. Lower fusing temperatures minimize the loss of moisture from paper, thereby reducing or eliminating paper curl. Furthermore, in process color applications and especially in pictorial color applications, toner to paper gloss matching is highly desirable. Gloss matching is referred to as matching the gloss of the toner image to the gloss of the paper. For example, when a low gloss image of preferably from about 1 to about 30 gloss is preferred, low gloss paper is utilized such of from about 1 to about 30 gloss units as measured by the Gardner Gloss metering unit, and which after image formation with small particle size toners of from about 3 to about 5 microns and fixing thereafter results in a low gloss toner image of from above about 1 to about 30 gloss units as measured by the Gardner Gloss metering unit. Alternatively, when higher image gloss is desired, such as from about above 30 to about 60 gloss units as measured by the Gardner Gloss metering unit, higher gloss paper is utilized such as from above about 30 to about 60 gloss units, and which after image formation with small particle size toners of the present invention of from about 3 to about 5 microns and fixing thereafter results in a higher gloss toner image of from about 30 to about 60 gloss units as measured by the Gardner Gloss metering unit. The aforementioned toner to paper matching can be attained with small particle size toners such as less than 7 microns and preferably less than 5 microns, such as from about 1 to about 4 microns such that the pile height of the toner layer(s) is low.

Numerous processes are known for the preparation of toners, such as, for example, conventional processes wherein a resin is melt kneaded or extruded with a pigment, micronized and pulverized to provide toner particles with an average volume particle diameter of from about 9 microns to about 20 microns and with broad geometric size distribution of from about above 1.4 to about 2.0. In such processes it is usually necessary to subject the aforementioned toners to a classification procedure such that the geometric size distribution of from about 1.2 to about 1.4 is attained. Also, in the aforementioned conventional process, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns, lower toner yields are obtained after classification, such as from about 50 percent to about 70 percent. With the processes of the present invention in embodiments, small average particle sizes of from about 3 microns to about 9, and preferably 5 microns are attained without resorting to classification processes, and where in narrow geometric size distributions are attained, such as from about 1.16 to about 1.35, and preferably from about 1.16 to about 1.30. High toner yields are also attained such as from about 90 percent to about 98 percent in embodiments. In addition, by the toner particle preparation process of the present invention in embodiments, small particle size toners of from about 3 microns to about 7 microns can be economically prepared in high yields such as from about 90 percent to about 98 percent by weight based on the weight of all the toner material ingredients.

There is illustrated in U.S. Pat. No. 4,996,127 a toner of associated particles of secondary particles comprising primary particles of a polymer having acidic or basic polar groups and a coloring agent. The polymers selected for the toners of this '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, note column 9, lines 50 to 55, wherein a polar monomer such as acrylic acid in the emulsion resin is necessary, and toner preparation is not obtained without the use, for example, of acrylic acid polar group, see Comparative Example I. The process of the present invention need not utilize polymers with polar acid groups, and toners can be prepared with resins such as poly(styrenebutadiene) or PLIOTONE TM without containing polar acid groups. Additionally, the toner of the '127 patent does not appear to utilize counterionic surfactant and flocculation processes. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process is thus directed to the use of coagulants, such as inorganic magnesium sulfate which results in the formation of particles with wide GSD. Furthermore, the '488 patent does not, it is believed, disclose the process of counterionic flocculation, and the importance of solid contents to control particle size. Similarly, the aforementioned disadvantages are noted in other prior art, such as U.S. Pat. No. 4,797,339, wherein there is disclosed a process for the preparation of toners by resin emulsion polymerization, wherein similar to the '127 patent polar resins of oppositely charges are selected; and U.S. Pat. No. 4,558,108, wherein there is disclosed a process for the preparation of a copolymer of styrene and butadiene by specific suspension polymerization. Other patents mentioned are 3,674,736; 4,137,188 and 5,066,560.

In U.S. Pat. No. 5,290,645, the disclosure of which is totally incorporated herein by reference, there is disclosed a process for the preparation of toners comprised of dispersing a polymer solution comprised of an organic solvent, and a polyester and homogenizing and heating the mixture to remove the solvent and thereby form toner composites. Additionally, there is disclosed in U.S. Pat. No. 5,278,020, the disclosure of which is totally incorporated herein by reference, a process for the preparation of in situ toners comprising an halogenization procedure which, for example, chlorinates the outer surface of the toner and results in enhanced blocking properties. More specifically, this patent application discloses an aggregation process wherein a pigment mixture, containing an ionic surfactant, is added to a resin mixture, containing polymer resin particles of less than 1 micron, nonionic and counterionic surfactant, thereby causing a flocculation to statically bound aggregates of about 0.5 to about 5 microns in volume diameter as measured by the Coulter Counter, and thereafter heating to form toner composites or toner compositions of from about 3 to about 7 microns in volume diameter.

In U.S. Pat. No. 5,308,734, the disclosure of which is totally incorporated herein by reference, there is illustrated a process for the preparation of toner compositions which comprises generating an aqueous dispersion of toner fines, ionic surfactant and nonionic surfactant, adding thereto a counterionic surfactant with a polarity opposite to that of said ionic surfactant, homogenizing and stirring said mixture, and heating to provide for coalescence of said toner fine particles.

In copending patent application U.S. Ser. No. 022,575 (D/92577), the disclosure of which is totally incorporated herein by reference, there is disclosed a process for the preparation of toner compositions comprising (i) preparing a pigment dispersion in a water, which dispersion is comprised of a pigment, an ionic surfactant and optionally a charge control agent;
(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent to form electrostatically bound toner size aggregates; and
(iii) heating the statically bound aggregated particles to form said toner composition comprised of polymeric resin, pigment and optionally a charge control agent.

Disadvantages that can be associated with the process of U.S. Ser. No. 022,575 (D/92577) is that toners of different size cannot usually be obtained, rather the size of the toner is altered only by alteration of the starting latex resin size and composition and the quantity of coagulant added to form the aggregates. When toner particles are prepared by varying the coagulant/resin ratio the chemical composition of the obtained toner, particularly the surface properties of the toner, can differ from one aggregate size to another, and this can cause differences in the xerographic behavior of the material as indicated in U.S. Pat. No. 5,213,938, the disclosure of which is totally incorporated herein by reference, since, for example, the xerographic toner charging process is, for example, very dependent on the toner surface chemistry.

In copending patent application U.S. Ser. No. 082,651, filed concurrently herewith, the disclosure of which is totally incorporated herein by reference, there is illustrated a process for the preparation of toner compositions with controlled particle size comprising:

(i) preparing a pigment dispersion in water, which dispersion is comprised of pigment, an ionic surfactant and an optional charge control agent;
(ii) shearing at high speeds the pigment dispersion with a polymeric latex comprised of resin, a counterionic surfactant with a charge polarity of opposite sign to that of said ionic surfactant, and a nonionic surfactant thereby forming a uniform homogeneous blend dispersion comprised of resin, pigment, and optional charge agent;
(iii) heating the above sheared homogeneous blend below about the glass transition temperature (Tg) of the resin while continuously stirring to form electrostatically bound toner size aggregates with a narrow particle size distribution;
(iv) heating the statically bound aggregated particles above about the Tg of the resin particles to provide coalesced toner comprised of resin, pigment and optional charge control agent, and subsequently optionally accomplishing (v) and (vi);
(v) separating said toner; and
(vi) drying said toner.

In copending patent application U.S. Ser. No. 083,146, (not yet assigned D/93106), filed concurrently herewith, the disclosure of which is totally incorporated herein by reference, there is illustrated a process for the preparation of toner compositions with a volume median particle size of from about 1 to about 25 microns, which process comprises:

(i) preparing by emulsion polymerization a charged polymeric latex of submicron particle size;

(ii) preparing a pigment dispersion in water, which dispersion is comprised of a pigment, an effective amount of cationic flocculant surfactant, and optionally a charge control agent;

(iii) shearing the pigment dispersion (ii) with a polymeric latex (i) comprised of resin, a counterionic surfactant with a charge polarity of opposite sign to that of said ionic surfactant thereby causing a flocculation or heterocoagulation of the formed particles of pigment, resin and charge control agent to form a high viscosity gel in which solid particles are uniformly dispersed;

(iv) stirring the above gel comprised of latex particles, and oppositely charged pigment particles for an effective period of time to form electrostatically bound relatively stable toner size aggregates with narrow particle size distribution; and (v) heating the electrostatically bound aggregated particles at a temperature above the resin glass transition temperature (Tg) thereby providing said toner composition comprised of resin, pigment and optionally a charge control agent.

In copending patent application U.S. Ser. No. 083,157, filed concurrently herewith, the disclosure of which is totally incorporated herein by reference, there is illustrated a process for the preparation of toner compositions with controlled particle size comprising:

(i) preparing a pigment dispersion in water, which dispersion is comprised of a pigment, an ionic surfactant in amounts of from about 0.5 to about 10 percent by weight of water, and an optional charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent;

(iii) stirring the resulting sheared viscous mixture of (ii) at from about 300 to about 1,000 revolutions per minute to form electrostatically bound substantially stable toner size aggregates with a narrow particle size distribution;

(iv) reducing the stirring speed in (iii) to from about 100 to about 600 revolutions per minute and subsequently adding further anionic or nonionic surfactant in the range of from about 0.1 to about 10 percent by weight of water to control, prevent, or minimize further growth or enlargement of the particles in the coalescence step (iii); and (v) heating and coalescing from about 5° to about 50° C. above about the resin glass transition temperature, Tg, which resin Tg is from between about 45° to about 90° C. and preferably from between about 50° and about 80° C., the statically bound aggregated particles to form said toner composition comprised of resin, pigment and optional charge control agent.

In copending patent application U.S. Ser. No. 082,741, filed concurrently herewith, the disclosure of which is totally incorporated herein by reference, there is illustrated a process for the preparation of toner compositions with controlled particle size and selected morphology comprising (i) preparing a pigment dispersion in water, which dispersion is comprised of pigment, ionic surfactant, and optionally a charge control agent;

(ii) shearing the pigment dispersion with a polymeric latex comprised of resin of submicron size, a counterionic surfactant with a charge polarity of opposite sign to that of said ionic surfactant and a nonionic surfactant thereby causing a flocculation or heterocoagulation of the formed particles of pigment, resin and charge control agent, and generating a uniform blend dispersion of solids of resin, pigment, and optional charge control agent in the water and surfactants;

(iii) (a) continuously stirring and heating the above sheared blend to form electrostatically bound toner size aggregates; or (iii) (b) further shearing the above blend to form electrostatically bound well packed aggregates; or (iii) (c) continuously shearing the above blend, while heating to form aggregated flake-like particles;

(iv) heating the above formed aggregated particles about above the Tg of the resin to provide coalesced particles of toner; and optionally (v) separating said toner particles from water and surfactants; and (vi) drying said toner particles.

In copending patent application U.S. Ser. No. 082,660, filed concurrently herewith, the disclosure of which is totally incorporated herein by reference, there is illustrated a process for the preparation of toner compositions comprising:

(i) preparing a pigment dispersion, which dispersion is comprised of a pigment, an ionic surfactant, and optionally a charge control agent;

(ii) shearing said pigment dispersion with a latex or emulsion blend comprised of resin, a counterionic surfactant with a charge polarity of opposite sign to that of said ionic surfactant and a nonionic surfactant;

(iii) heating the above sheared blend below about the glass transition temperature (Tg) of the resin to form electrostatically bound toner size aggregates with a narrow particle size distribution; and (iv) heating said bound aggregates above about the Tg of the resin.

SUMMARY OF THE INVENTION

Figure 1:
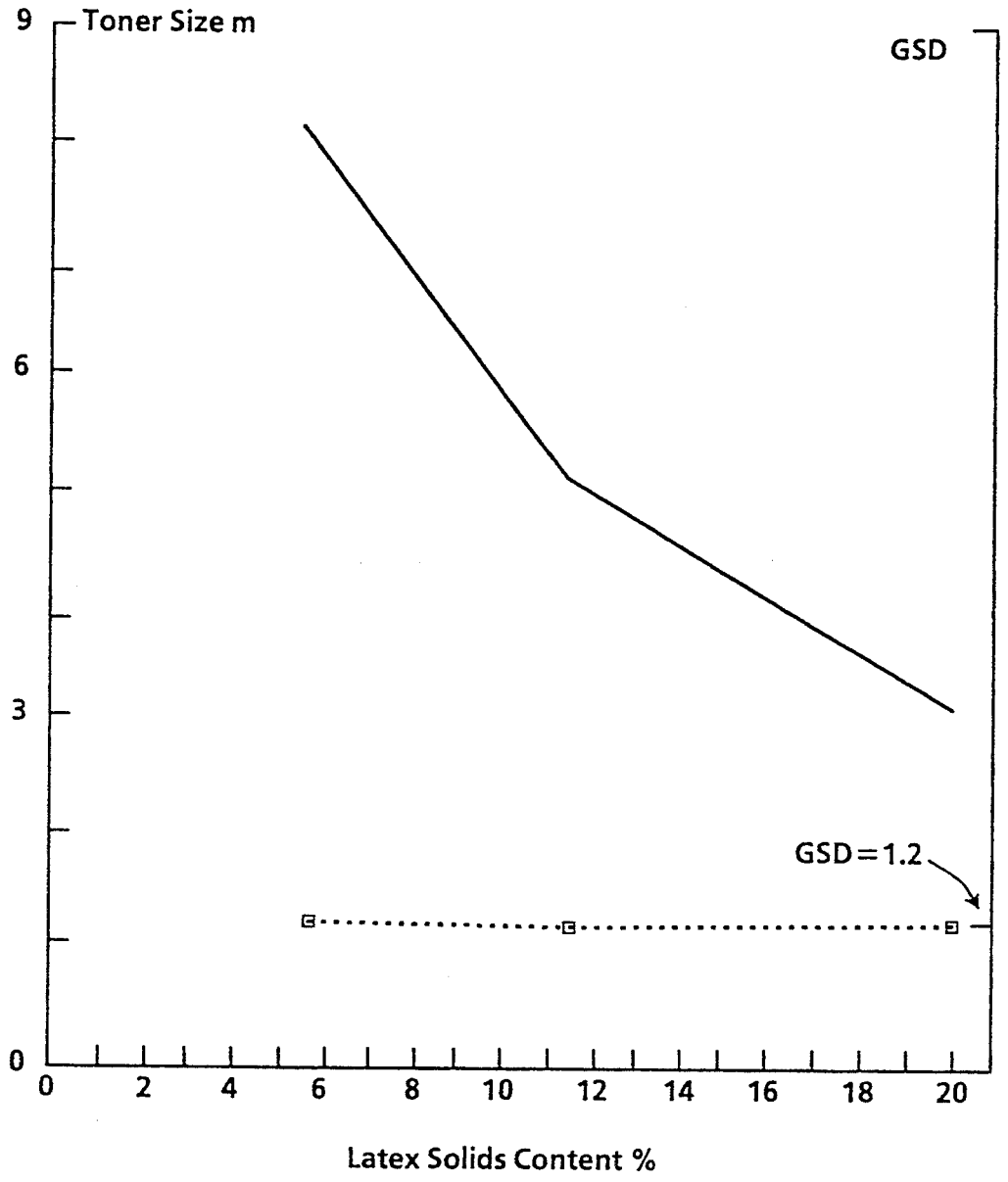
FIG. 1 shows the dependence of the final aggregate and tower size on the latex solids or resin loadings.

It is an object of the present invention to provide toner processes with many of the advantages illustrated herein.

In another object of the present invention there are provided simple and economical processes for the direct preparation of black and colored toner compositions with, for example, excellent pigment dispersion and narrow GSD.

In another object of the present invention there are provided simple and economical in situ processes for black and colored toner compositions by an aggregation process comprised of (i) preparing a cationic pigment mixture, containing pigment particles, and optionally charge control agents and other known optional additives dispersed in a water containing a cationic surfactant by shearing, microfluidizing or ultrasonifying; (ii) shearing the aforementioned pigment mixture with a latex mixture comprised of a polymer resin, and suitable surfactants in water thereby causing a flocculation or heterocoagulation, which on shearing and further stirring for from about 1 to about 4 hours allows the formation of electrostatically stable aggregates of from about 0.5 to about 5 microns in volume diameter as measured by the Coulter Counter; and (iii) coalescing or fusing the aggregated particles by heating in the range, for example, of from about 60° to about 95° C., to form toner composites, or a toner composition comprised of resin, pigment, and charge additive, wherein the concentration of the latex, such as polystyrene/polybutylacrylate and polyacrylic acid, is decreased from 40 percent to 2 percent solids and preferably from 30 percent to 5 percent by weight solids.

In a further object of the present invention there is provided a process for the preparation of toners with an average particle diameter of from between about 0.5 to about 20 microns, and preferably from about 1 to about 10 microns, and with a narrow GSD of from about 1.15 to about 1.35 and preferably from about 1.2 to about 1.3 as measured by the Coulter Counter.

Moreover, in a further object of the present invention there is provided a process for the preparation of toners which after fixing to paper substrates result in images with gloss of from 20 GGU up to 70 GGU as measured by Gardner Gloss meter matching of toner and paper.

In another object of the present invention there are provided composite polar or nonpolar toner compositions in high yields of from about 90 percent to about 100 percent by weight of toner without resorting to classification, and wherein by varying the latex concentration and maintaining the latex/coagulant ratio provides toner aggregates at various size diameters.

In yet another object of the present invention there are provided toner compositions with low fusing temperatures of from about 110° C. to about 150° C. and with excellent blocking characteristics at from about 50° C. to about 60° C.

Moreover, in another object of the present invention there are provided toner compositions with high projection efficiency such as from about 75 to about 95 percent efficiency as measured by the Match Scan 11 spectrophotometer available from Milton-Roy.

In a further object of the present invention there are provided toner compositions which result in low or no paper curl.

Another object of the present invention resides in processes for the preparation of small sized toner particles with narrow GSDs, and excellent pigment dispersion by the aggregation of latex particles, with pigment particles dispersed in water and surfactant, and wherein the aggregated particles, of toner size, can then be caused to coalesce by, for example, heating. In embodiments, factors of importance with respect to controlling particle size and GSD include the concentration of the surfactant used for the pigment dispersion, concentration of the component, like acrylic acid in the latex, the temperature of coalescence, the solids contents, and the time of coalescence.

These and other objects of the present invention are accomplished in embodiments by the provision of toners and processes thereof. In embodiments of the present invention, there are provided processes for the economical direct preparation of toner compositions by an improved flocculation or heterocoagulation, and coalescence processes and wherein the cationic coagulant surfactant amount selected is in a fixed proportion to the latex anionic surfactant present in the mixture and the final toner particle size, that is average volume diameter and GSD is controlled by varying the solids loading of the latex dispersion in the range of from about 40 percent to about 2 percent, and preferably from 30 percent to 5 percent.

In embodiments, the present invention is directed to a process for the preparation of toner compositions comprising (i) preparing a pigment dispersion in water, which dispersion is comprised of pigment, a counterionic surfactant with a charge polarity of opposite sign to the anionic surfactant of (ii) surfactant and optionally a charge control agent;

(ii) shearing the pigment dispersion with a latex comprised of resin, anionic surfactant, nonionic surfactant, and water; and wherein the latex solids content, which solids are comprised of resin, is from about 50 percent to about 20 weight percent thereby causing a flocculation or heterocoagulation of the formed particles of pigment, resin and optional charge control agent; diluting with water to form a dispersion of total solids of from about 30 percent to 1 weight percent, which total solids are comprised of resin, pigment and optional charge control agent contained in a mixture of said nonionic, anionic and cationic surfactants;

(iii) heating the above sheared blend at a temperature of from about 5° to about 25° C. below about the glass transition temperature Tg of the resin while continuously stirring to form toner sized aggregates with a narrow size dispersity; and (iv) heating the electrostatically bound aggregated particles at a temperature of from about 5° to about 50° C. above about the Tg of the resin to provide a toner composition comprised of resin, pigment and optionally a charge control agent.

In embodiments, the present invention is directed to processes for the preparation of toner compositions which comprises initially attaining or generating an ionic pigment dispersion, for example by dispersing an aqueous mixture of a pigment or pigments such as phthalocyanine, quinacridone or Rhodamine B type with counterionic surfactant, such as a cationic surfactant such as benzalkonium chloride by utilizing a high shearing device such as a Brinkmann Polytron, thereafter shearing this mixture by utilizing a high shearing device such as a Brinkmann Polytron, a sonicator or microfluidizer with a controlled solids content of suspended resin mixture comprised of polymer or resin particles such as poly(styrene butadiene) or poly(styrenebutylacrylate) and of particle size ranging from 0.01 to about 0.5 micron, in an aqueous surfactant mixture containing an anionic surfactant such as sodium dodecylbenzene sulfonate and nonionic surfactant; resulting in a flocculation, or heterocoagulation of the resin particles with the pigment particles caused by the neutralization of cationic surfactant absorbed on the pigment particle with the oppositely charged anionic surfactant absorbed on the resin particles; and further for from about 1 to about 4 hours stirring the mixture using a mechanical stirrer at 250 to 500 rpm and allowing the formation of electrostatically stabilized aggregates ranging in diameter of from about 0.5 micron to about 10 microns; and heating for 1 to 6 hours from about 60° to about 95° C. to provide for particle fusion or coalescence of the polymer and pigment particles; followed by washing with, for example, hot water to remove surfactant, and drying such as by use of an Aeromatic fluid bed dryer whereby toner particles comprised of resin and pigment with various particle size diameters can be obtained, such as from about 1 to about 10 microns in average volume particle diameter as measured by the Coulter Counter.

Embodiments of the present invention include a process for the preparation of toner compositions comprising (i) preparing a pigment dispersion in a water, which dispersion is comprised of a pigment, an ionic surfactant and optionally a charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent; and (iii) diluting with water and stirring the sheared blend at elevated temperature, for example from about 30° to about 50° C., but about below the resin Tg, for example from about 5° to about 15° C. below the resin Tg, to form electrostatically bound or attached toner size aggregates; heating, for example from about 5° to 50° C. above the resin Tg, the statically bound aggregated particles to form a toner composition comprised of polymeric resin, pigment and optionally a charge control agent and wherein the solids concentration of the latex of resin such as a copolymer of styrene, butyl acrylate and acrylic acid is varied from about 40 percent to about 1 percent by weight, and preferably from 30 percent to 5 percent by weight, to obtain toner particles with narrow size distributions of similar chemical composition whose size depends inversely on the solids loading of the latex used. Thus, by increasing the solids content the particle size of aggregates can be caused to decrease.

Also, in embodiments the present invention is directed to processes for the preparation of toner compositions which comprises (i) preparing an ionic pigment mixture by dispersing a pigment such as carbon black like REGAL 330 TM, HOSTAPERM PINK TM, or PV FAST BLUE TM of from about 2 to about 10 percent by weight of toner in an aqueous mixture containing a cationic surfactant such as dialkylbenzene dialkylammonium chloride like SANIZOL B-50 TM available from KAO or MIRAPOL TM available from Alkaril Chemicals of from about 0.5 to about 2 percent by weight of water, utilizing a high shearing device such as a Brinkmann Polytron or IKA homogenizer at a speed of from about 3,000 revolutions per minute to about 10,000 revolutions per minute for a duration of from about 1 minute to about 120 minutes; (ii) adding the aforementioned ionic pigment mixture to an aqueous suspension of resin particles comprised of, for example, poly(styrene-butylmethacrylate), PLIOTONE TM or poly(styrenebutadiene) of from about 88 percent to about 98 percent by weight of the toner, and of about 0.1 micron to about 3 microns polymer particle size in volume average diameter, and counterionic surfactant such as an anionic surfactant like sodium dodecyl sulfate, dodecylbenzene sulfonate or NEOGEN R TM from about 0.5 to about 2 percent by weight of water, a nonionic surfactant such polyethylene glycol or polyoxyethylene glycol nonyl phenyl ether or IGEPAL 897 TM obtained from GAF Chemical Company, of from about 0.5 to about 3 percent by weight of water, thereby causing a flocculation or heterocoagulation of pigment, charge control additive and resin particles; (iii) diluting the aggregate particle mixture with water from about 30 percent solids to about 25 to 2 percent solids; (iv) homogenizing the resulting flocculent mixture with a high shearing device such as a Brinkmann Polytron or IKA homogenizer at a speed of from about 3,000 revolutions per minute to about 10,000 revolutions per minute for a duration of from about 1 minute to about 120 minutes, thereby resulting in a homogeneous mixture of latex and pigment and further stirring with a mechanical stirrer at from about 250 to 500 rpm to form electrostatically stable aggregates of from about 0.5 microns to about 5 microns in average volume diameter; (v) heating the statically bound aggregate composite particles of from about 60° C. to about 95° C. for a duration of about 60 minutes to about 600 minutes to form toner sized particles of from about 3 microns to about 7 microns in volume average diameter and with a geometric size distribution of from about 1.2 to about 1.4 as measured by the Coulter Counter; and (vi) isolating the toner sized particles by washing, filtering and drying thereby providing a toner comprised of polymeric resin, pigment and optionally charge control agent. Additives to improve flow characteristics and charge additives to improve charging characteristics may be optionally added by blending with the toner, such additives including AEROSILS ® or silicas, metal oxides like tin, titanium and the like, of from about 0.1 to about 10 percent by weight of the toner.

In some instances, pigments which are available in the wet cake or concentrated form containing water, can be easily dispersed utilizing a homogenizer or with stirring. In other instances, pigments are available in a dry form, whereby a dispersion in water can be effected by microfluidizing using, for example, a M-110 microfluidizer and passing the pigment dispersion from about 1 to 10 times through the fluidizer chamber, or by sonication, such as using a Branson 700 sonicator, with the optional addition of dispersing agents such as the aforementioned ionic or nonionic surfactants.

Embodiments of the present invention include a process for the preparation of toner compositions comprising (i) preparing a pigment dispersion in water, which dispersion is comprised of a pigment and a cationic surfactant;

(ii) shearing the pigment dispersion with a latex containing a controlled resin solid contents of from about 50 percent to about 20 percent of polymer or resin, an anionic surfactant and nonionic surfactant in water, thereby causing a flocculation or heterocoagulation of the formed particles of pigment, resin and charge control agent to form a dispersion of total solids of from about 30 percent to 2 percent comprised of resin and pigment particles contained in the mixture of nonionic, anionic and cationic surfactants;

(iii) heating the above sheared blend at a temperature of from about 5° to about 25° C. below about the glass transition temperature Tg of the resin, or about equal to the Tg while continuously stirring to form toner sized aggregates with a narrow size dispersity; and (iv) heating the electrostatically bound aggregated particles at a temperature of from about 5° to about 50° C. above about the Tg of the resin to provide said toner composition comprised of resin and pigment.

Embodiments of the present invention include a process for the preparation of toner compositions with controlled particle size comprising (i) preparing a pigment dispersion in water, which dispersion is comprised of a pigment and counterionic surfactant;

(ii) shearing the pigment dispersion with a latex, which latex contains a resin solid content of from about 50 percent by weight to about 20 percent by weight, an anionic surfactant, and nonionic surfactant in water thereby causing a flocculation or heterocoagulation of the formed particles of pigment and resin to form a uniform dispersion of total solids from about 30 percent by weight to about 2 percent by weight, comprised of resin and pigment particles dispersed in the mixture of nonionic, anionic and counterionic surfactants;

(iii) heating the above sheared blend at a temperature of from about 5° to about 25° C. below the glass transition temperature Tg of the resin while continuously stirring to form toner sized aggregates with a narrow size dispersity;

(iv) heating the electrostatically bound aggregated particles at a temperature of from about 5° to about 50° C. above the Tg of the resin to provide said toner composition comprised of resin and pigment; and optionally (v) separating said toner particles from the water in (i) by filtration, or centrifugation; and (vi) drying the said toner particles.

Illustrative examples of resins selected for the process of the present invention include known polymers like poly(styrene-butadiene), poly(para-methyl styrene-butadiene), poly(meta-methyl styrenebutadiene), poly(alpha-methyl styrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene), terpolymers such as poly(styrene-butadiene-acrylic acid), poly(styrene-butadiene-methacrylic acid), PLIOTONE TM available from Goodyear, polyethylene-terephthalate, polypropylene-terephthalate, polybutylene-terephthalate, polypentylene-terephthalate, polyhexalene-terephthalate, polyheptadene-terephthalate, polyoctalene-terephthalate, POLYLITE TM (Reichhold Chemical Inc), PLASTHALL TM (Rohm & Haas), CYGAL TM (American Cyanamide), ARMCO TM (Armco Composites), CELANEX TM (Celanese Eng), RYNITE TM (DuPont), STYPOL TM, and the like. The resin particles selected, which generally can be in embodiments styrene acrylates, styrene butadienes, styrene methacrylates, or polyesters, are present in various effective amounts, such as from about 85 weight percent to about 98 weight percent of the toner, and can be of small average (resin) particle size such as from about 0.01 micron to about 1 micron in average volume diameter as measured by the Brookhaven nanosize particle analyzer.

The resin selected for the process of the present invention can be prepared by emulsion polymerization techniques, and the monomers utilized in such processes can be selected from the group consisting of styrene, acrylates, methacrylates, butadiene, isoprene, and optionally acid or basic olefinic monomers such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride, and the like. The presence of acid or basic groups is optional and such groups can be present in various amounts of from about 0.1 to about 10 percent by weight of the polymer resin. Known chain transfer agents such as dodecanethiol or carbon tetrachloride can also be selected when preparing resin particles by emulsion polymerization. Other process of obtaining resin particles of from about 0.01 micron to about 3 microns can be selected from polymer microsuspension process, such as disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding process, or other known processes. Also, the resins selected can be purchased.

Various known colorants or pigments present in the toner in an effective amount of, for example, from about 1 to about 25 percent by weight of the toner, and preferably in an amount of from about 1 to about 15 weight percent, that can be selected include carbon black, like REGAL 330®, REGAL 400®, REGAL 660®; magnetites, such as Mobay magnetites MO8029 TM, MO8060 TM; Columbian magnetites; MAPICO BLACKS TM and surface treated magnetites; Pfizer magnetites, CB4799 TM, CB5300 TM, CB5600 TM, MCX6369 TM; Bayer magnetites, BAYFERROX 8600 TM, 8610 TM; Northern Pigments magnetites, NP-604 TM, NP-608 TM; Magnox magnetites TMB-100 TM, or TMB-104 TM; and other equivalent black pigments. As colored pigments there can be selected known cyan, magenta, yellow, red, green, brown, blue or mixtures thereof. Specific examples of pigments include phthalocyanine HELIOGEN BLUE L6900 TM, D6840 TM, D7080 TM, PYLAM OIL BLUE TM, PYLAM OIL YELLOW TM, PIGMENT BLUE 1 TM available from Paul Uhlich & Company, Inc., PIGMENT VIOLET 1 TM, PIGMENT RED 48 TM, LEMON CHROME YELLOW DCC 1026 TM, E.D. TOLUIDINE RED TM and BON RED C TM available from Dominion Color Corporation, Ltd., Toronto, Ontario, NOVAperm YELLOW FGL TM, HOSTAPERM PINK E TM from Hoechst, and CINQUASIA MAGENTA TM available from E. I. DuPont de Nemours & Company, and the like. Generally, colored pigments that can be selected are cyan, magenta, red, blue, green, brown, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK TM, and cyan components may also be selected as pigments with the process of the present invention. The pigments or dyes selected are present in various effective amounts, such as from about 1 weight percent to about 65 weight and preferably from about 2 to about 12 percent of the toner.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, and the like.

Surfactants in amounts of, for example, 0.1 to about 25 weight percent in embodiments include, for example, nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol (available from Rhone-Poulenac as IGEPAL CA-210 TM, IGEPAL CA-520 TM, IGEPAL CA-720 TM, IGEPAL CO-890 TM, IGEPAL CO-720 TM, IGEPAL CO-290 TM, IGEPAL CA-210 TM, ANTAROX 890 TM and ANTAROX 897 TM. An effective concentration of the nonionic surfactant is, for example, from about 0.01 to about 10 percent by weight, and preferably from about 0.1 to about 5 percent by weight of monomers selected to prepare the copolymer resin, or in amounts as indicated herein.

Examples of ionic surfactants include cationic and anionic surfactants with examples of anionic surfactants being, for example, sodium dodecyl sulfate (SDS), sodium dodecylbenzene sulfonate, sodium dodecylnaphthalene sulfate, dialkyl benzenealkyl, sulfates and sulfonates, abitic acid, available from Aldrich, NEOGEN R TM, NEOGEN SC TM from Kao and the like. An effective concentration of the anionic surfactant generally employed is, for example, from about 0.01 to about 10 percent by weight, and preferably from about 0.1 to about 5 percent by weight of monomers selected to prepare the copolymer resin, or in amounts as indicated herein.

Examples of cationic surfactants selected for the processes of the present invention are, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL TM and ALKAQUAT TM available from Alkaril Chemical Company, SANIZOL TM (benzalkonium chloride), available from Kao Chemicals, and the like, and mixtures thereof. This surfactant is utilized in various effective amounts, such as, for example, from about 0.1 percent to about 5 percent by weight of water. Preferably the molar ratio of the cationic surfactant used for flocculation to the anionic surfactant used in the latex preparation is in range of about 0.5 to 4, preferably from about 0.5 to 2.

The temperature for the aggregation is preferably accomplished in the range of from about 5° to about 20° C. below the resin Tg, which resin Tg is, for example, from about 45° to about 80° C., and preferably from about 30° to about 50° C., while being stirred for from about 1 to about 4 hours for example. The resulting total solids comprise latex particles and pigment particles. The aggregate particles are then coalesced by raising the temperature to about 5° to about 50° C. above the resin Tg, for example, from about 60° to about 95° C.

Surface additives that can be added to the toner compositions after washing or drying include, for example, metal salts, metal salts of fatty acids, like zinc stearate, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972 ® available from Degussa in amounts of from 0.1 to 2 percent which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Latex solids refers in embodiments to the amount of resin, such as 50 to 20 weight percent of the latex of (ii); and total solids refers in embodiments to resin, pigment, and optional charge additive or charge control agent. The solids contents, that is resin, is reduced by diluting with water, for example, to from about 30 to about 1 percent by weight of total solids. Various effective amounts of water can be selected for dilution as indicated herein.

The following Examples are being submitted to further define various species of the present invention. These Examples are intended to be illustrative only and are not intended to limit the scope of the present invention. Also, parts and percentages are by weight unless otherwise indicated.

EXAMPLES

Preparation of the Toner Resin

A latex was prepared by emulsion polymerization as follows:

Latex A: 4,920 Grams of styrene, 1,080 grams of butyl acrylate, 120 grams of acrylic acid, 60 grams of carbon tetrabromide and 210 grams of dodecanethiol were mixed with 9,000 grams of deionized water in which 135 grams of sodium dodecyl benzene sulfonate (SDBS) anionic surfactant (NEOGEN R TM which contains 60 percent of active component and 40 percent of water component), 129 grams of polyoxyethylene nonyl phenyl ether—nonionic surfactant (ANTAROX 897 TM—70 percent active—polyethoxylated alkylphenols), and 60 grams of ammonium persulfate initiator were dissolved. The emulsion was then polymerized at 80° C. for 5 hours. A latex containing 40 percent solids of polymeric or resin particles of a copolymer of styrene, butylacrylate and acrylic acid (88/12/2 parts) with a particle size of 150 nanometers, as measured on Brookhaven nanosizer, was obtained. Tg=53° C., as measured on DuPont DSC. $M_w$=20,000, and $M_n$=6,000 as determined on Hewlett Packard GPC. The aforementioned latex was then selected for the toner preparation of Examples I to IV.

Preparation of the Pigment Dispersion

A pigment dispersion was prepared as follows:

Pigment Dispersion B: 280 Grams of dry PV FAST BLUE TM pigment and 58.5 grams of the cationic or counterionic surfactant SANIZOL B-50 TM were suspended in 8,000 grams of distilled water and subsequently passed through a microfluidizer until the dispersion was homogeneous. This mixture was then utilized to form the toner in Examples I and II.

Pigment Dispersion C: 15 Grams of SUN FAST BLUE L TM pigment and 8.8 grams of the cationic surfactant SANIZOL B-50 TM were suspended in 500 grams of distilled water and homogenized using the inline homogenizer IKA SD41. This mixture was then utilized to form the toner in Example III.

PREPARATION OF TONER PARTICLES

Example I

417 Grams of the PV FAST BLUE TM dispersion (Pigment B) and 650 grams of the latex (Latex A) were simultaneously added into a SD41 continuous blending device which contained and was diluted with 1,200 grams of water. Homogenization was achieved by recirculating the contents of the SD41 continuously through the shearing chamber at 10,000 rpm for 8 minutes. The product resulting was then transferred to a controlled temperature kettle and heated at 45° C. while gently stirring for 3 hours. The aggregate produced had a diameter of 5.1 microns average volume diameter with a GSD of 1.21 as determined by particle diameter measurements using the Coulter Counter (Microsizer II). At this point, 40 grams of a 20 percent by weight solution of NEOGEN R TM in water was added to the kettle to prevent the formed aggregates from further aggregating and increasing in size during the following coalescence stage of the process.

The kettle contents were then heated to 85° C. while stirring for about 4 hours. The particle size was measured again on the Coulter Counter. Toner particles of 5.1 microns were obtained with a GSD=1.21, indicating no further growth in the particle size. The particles were then washed with water and dried. The aforementioned cyan toner was comprised of 88 parts of polystyrene, 12 parts of polybutylacrylate, 2 parts of polyacrylic acid and 5.5 percent (5.61 parts) of cyan pigment particles prepared under conditions of 11.5 percent solids or resin loading of the latex in the blend of (ii) of resin, pigment, nonionic, anionic, cationic surfactant and water. The yield of the toner particles was 98 percent.

Example II

417 Grams of the PV FAST BLUE TM dispersion (pigment dispersion B), which contains 50 grams of pigment and 366 grams of water, and a mixture of 324 grams of the latex containing 210 grams of water and 140 grams of the polymeric particles, and 325 grams of water were simultaneous added into a SD-41 inline homogenizing device which contained and was diluted with 1,200 grams water. The aggregation was performed in a kettle under the same conditions as described in Example I. In this Example the aggregate was found to have a diameter of 8.1 microns with a GSD of 1.25. The addition of 40 grams of a 20 percent by weight solution of NEOGEN R TM in water and heating at 85° C. for 4 hours provided a toner of dimensional characteristics unchanged from that observed for the aggregate. The cyan toner particles obtained were comprised of 88 parts of polystyrene, 12 parts of polybutylacrylate, 2 parts of polyacrylic acid and 5.5 percent of pigment (5.7 percent solids loading) possess the same Tg (Tg=53° C.) as the latex and the toner yield was 98 percent.

Example III

418 Grams of the SUN FAST BLUE TM dispersion (pigment dispersion C) was mixed with an additional 5.9 grams of SANIZOL B50 TM in 100 grams of water and this pigment mixture and 975 grams of the latex were simultaneously added into the SD-41 inline homogenizing device which contained as the diluent 500 grams of water. The aggregation was performed in a continuously stirred kettle which was heated to 45° C. The aggregates formed were found to have a diameter of 2.9 microns with a GSD of 1.22. 50 Grams of a 20 percent by weight solution of NEOGEN R TM in water was then added followed by heating at 85° C. for four hours to provide toner comprised of 88 parts of polystyrene, 12 parts of polybutylacrylate, 2 parts of polyacrylic acid and 5.5 percent of pigment, which toner is 3.0 microns in volume diameter with a volume GSD of 1.22. The cyan toner particles prepared (20.0 percent solids) have the same Tg (Tg =53° C.) as the latex, and the toner yield was 98 percent.

The dependence of the final aggregate and toner size on the latex solids or resin loadings is summarized in the following table and FIG. 1, where the x axis represents the percent latex resin loading, calculated theoretically, while the y axis represents the particle size (average volume diameter) as measured on the Coulter Counter as is the GSD.

| LATEX RESIN LOADING | AGGREGATE AND TONER PARTICLE SIZE | TONER GSD |
|---|---|---|
| 20.0 | 3.1 | 1.22 |
| 11.5 | 5.1 | 1.21 |
| 5.7 | 8.1 | 1.25 |

Other embodiments and modifications of the present invention may occur to those skilled in the art subsequent to a review of the information presented herein; these embodiments and modifications, as well as equivalents thereof, are also included within the scope of this invention.

What is claimed is:

1. A process for the preparation of toner compositions comprising (i) preparing a pigment dispersion in water, which dispersion is comprised of pigment, a counterionic surfactant with a charge polarity of opposite sign to the anionic surfactant of (ii) and optionally a charge control agent;

(ii) shearing the pigment dispersion with a latex comprised of resin, anionic surfactant, nonionic surfactant, and water; and wherein the latex solids content, which solids are comprised of resin, is from about 50 weight percent to about 20 weight percent thereby causing a flocculation or heterocoagulation of the formed particles of pigment, resin and optional charge control agent; diluting with water to form a dispersion of total solids of from about 30 weight percent to 1 weight percent, which total solids are comprised of resin, pigment and optional charge control agent contained in a mixture of said nonionic, anionic and cationic surfactants;

(iii) heating the above sheared blend at a temperature of from about 5° to about 25° C. below about the glass transition temperature (Tg) of the resin while continuously stirring to form toner sized electrostatically bound aggregates with a narrow size dispersity; and (iv) heating the electrostatically bound aggregates at a temperature of from about 5° to about 50° C. above about the Tg of the resin to provide a toner composition comprised of resin, pigment and optionally a charge control agent.

2. A process in accordance with claim 1 wherein the surfactant utilized in preparing the pigment dispersion is a cationic surfactant, and the Tg in (iii) and (iv) from about 45° to about 90° C.

3. A process in accordance with claim 1 wherein the total solids content is from about 2 to about 10 weight percent.

4. A process in accordance with claim 1 wherein the concentration of resin in the latex is from about 60 percent to about 20 percent.

5. A process in accordance with claim 1 (ii) wherein the content of the resin solids after flocculation is controlled to from about 20 percent to about 5 percent by weight, and the particle size of the aggregate in (iii) is from about 1 micron to about 15 microns in average volume diameter.

6. A process in accordance with claim 1 wherein larger aggregated particles of from about 8 microns to about 20 microns are formed at lower total solids content of about 6 percent to about 20 percent in polymeric latex particles, pigment particles, and wherein smaller aggregated particles of from about 7 microns to about 2 microns are formed at a higher total solids content of about 7 percent to about 25 percent.

7. A process in accordance with claim 1 wherein the dispersion of (i) is accomplished by homogenizing at from about 1,000 revolutions per minute to about 10,000 revolutions per minute at a temperature of from about 25° C. to about 35° C. for a duration of from about 1 minute to about 120 minutes.

8. A process in accordance with claim 1 wherein the dispersion of (i) is accomplished by an ultrasonic probe at from about 300 watts to about 900 watts of energy, at from about 5 to about 50 megahertz of amplitude, at a temperature of from about 25° C. to about 55° C., and for a duration of from about 1 minute to about 120 minutes.

9. A process in accordance with claim 1 wherein the dispersion of (i) is accomplished by microfluidization in a microfluidizer or in nanojet for a duration of from about 1 minute to about 120 minutes.

10. A process in accordance with claim 1 wherein the shearing (ii) is accomplished by homogenizing at from about 1,000 revolutions per minute to about 10,000 revolutions per minute for a duration of from about 1 minute to about 120 minutes.

11. A process in accordance with claim 1 wherein the heating of the blend of latex, pigment, surfactants and optional charge control agent in (iii) is accomplished at temperatures from about 5° C. to about 20° C. below the Tg of the resin, which Tg is in the range of from about 48° C. to about 72° C., and which heating is accomplished for a duration of from about 0.5 hour to about 6 hours.

12. A process in accordance with claim 1 wherein the heating of the electrostatically bound aggregate particles to form toner size composite particles comprised of pigment, resin and optional charge control agent is accomplished at a temperature of from about 10° C. above the Tg of the resin to about 95° C. above the Tg of the resin and for a duration of from about 1 hour to about 8 hours.

13. A process in accordance with claim 1 wherein the resin is selected from the group consisting of poly(styrene-butadiene), poly(paramethyl styrene-butadiene), poly(meta-methyl styrene-butadiene), poly(alpha-methylstyrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene).

14. A process in accordance with claim 1 wherein the resin is selected from the group consisting of poly(styrene-butadiene-acrylic acid) poly(styrene-butadiene-methacrylic acid) poly(styrene-butylmethacrylate-acrylic acid), poly(styrene-butylacrylate-acrylic acid), polyethylene-terephthalate, polypropylene-terephthalate, polybutylene-terephthalate, polypentylene-terephthalate, polyhexalene-terephthalate, polyheptadene-terephthalate, poly(styrene-butadiene), and polyoctalene-terephthalate.

15. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol.

16. A process in accordance with claim 1 wherein the anionic surfactant is selected from the group consisting of sodium dodecyl sulfate, sodium dodecylbenzene sulfate and sodium dodecylnaphthalene sulfate, and the cationic surfactant is a quaternary ammonium salt.

17. A process in accordance with claim 1 wherein the resin utilized in (ii) is from about 0.01 to 3 microns in average volume diameter.

18. A process in accordance with claim 1 wherein the pigment particles are from about 0.01 to about 1 micron in average volume diameter.

19. A process in accordance with claim 1 wherein the toner obtained is from about 2 to about 15 microns in average volume diameter, and the geometric size distribution is from about 1.15 to about 1.30.

20. A process in accordance with claim 1 wherein the statically bound aggregate particles formed in (iv) are about 1 to about 10 microns in average volume diameter.

21. A process in accordance with claim 1 wherein the nonionic surfactant concentration is about 0.1 to about 5 weight percent of the toner components of resin and pigment; the anionic surfactant concentration is about 0.1 to about 5 weight percent of the toner components of resin and pigment; and the counterionic surfactant concentration is about 0.1 to about 5 weight percent of the toner of resin and pigment.

22. A process in accordance with claim 1 wherein there is added to the surface of the isolated toner particles additives of metal salts, metal salts of fatty acids, silicas, metal oxides, or mixtures thereof in an amount of from about 0.1 to about 10 weight percent.

23. A process in accordance with claim 1 wherein the toner is washed with warm water and the surfactants are removed from the toner surface, followed by drying.

24. A process in accordance with claim 1 wherein the toner particles isolated are from about 3 to about 15 microns in volume average diameter, and the geometric size distribution is from about 1.15 to about 1.25.

25. A process for the preparation of toner with controlled particle size comprising (i) preparing a pigment dispersion in water, which dispersion is comprised of a pigment and counterionic surfactant;

(ii) shearing the pigment dispersion with a latex, which latex contains a resin content of from about 50 percent by weight to about 20 percent by weight, thereby causing a flocculation or heterocoagulation of the formed particles of pigment and resin; diluting with water to form a uniform dispersion of total solids from about 30 percent by weight to about 2 percent by weight;

(iii) heating the above sheared blend at a temperature of from about 5° C. to about 25° C. about below the glass transition temperature (Tg) of the resin while continuously stirring to form toner sized electrostatically bound aggregates with a narrow size dispersity;

(iv) heating the electrostatically bound aggregates at a temperature of from about 5° C. to about 50° C. about above the Tg of the resin to provide said toner composition comprised of polymeric resin, pigment and optionally a charge control agent; and optionally (v) separating said toner particles from the water; and (vi) drying said toner particles;

wherein said latex comprises resin, anionic surfactant, nonionic surfactant and water, and said total solids components are comprised of resin and pigment.

26. A process in accordance with claim 25 wherein the (iii) and (iv) resin glass transition temperature (Tg) is from about 50° C. to about 80° C.

27. A process in accordance with claim 25 wherein the resin glass transition temperature (Tg) is from about 45° C. to about 90° C.

28. A process in accordance with claim 25 wherein the resin glass transition temperature (Tg) is from about 50° C. to about 80° C.

29. A process in accordance with claim 25 wherein heating in (iii) or (iv) is accomplished at the glass transition temperature.

30. A process for the preparation of toner compositions consisting essentially of (i) preparing a pigment dispersion in water, which dispersion is comprised of pigment, a counterionic surfactant with a charge polarity of opposite sign to the anionic surfactant of (ii) and optionally a charge control agent;

(ii) shearing the pigment dispersion with a latex comprised of resin, anionic surfactant, nonionic surfactant, and water; and wherein the latex solids content, which solids are comprised of resin, is from about 50 weight percent to about 20 weight percent thereby causing a flocculation or heterocoagulation of the formed particles of pigment, resin and optional charge control agent; diluting with water to form a dispersion of total solids of from about 30 weight percent to 1 weight percent, which total solids are comprised of resin, pigment and optional charge control agent contained in a mixture of said nonionic, anionic and cationic surfactants;

(iii) heating the above sheared blend at a temperature of from about 5° to about 25° C. below about the glass transition temperature (Tg) of the resin while continuously stirring to form toner sized electrostatically bound aggregates with a narrow size dispersity; and (iv) heating the electrostatically bound aggregates at a temperature of from about 5° to about 50° C. above about the Tg of the resin to provide a toner composition comprised of resin, pigment and optionally a charge control agent.

* * * * *